US008556244B2

(12) United States Patent
Coffman

(10) Patent No.: US 8,556,244 B2
(45) Date of Patent: Oct. 15, 2013

(54) ADJUSTABLE ANGLE CLAMP

(76) Inventor: Randall R. Coffman, Richmond, KY (US)

( * ) Notice: Subject to any disclaimer, the term of this patent is extended or adjusted under 35 U.S.C. 154(b) by 1062 days.

(21) Appl. No.: 12/562,234

(22) Filed: Sep. 18, 2009

(65) Prior Publication Data

US 2011/0068526 A1 Mar. 24, 2011

(51) Int. Cl.
*B25B 5/16* (2006.01)

(52) U.S. Cl.
USPC ..... 269/41; 269/228

(58) Field of Classification Search
USPC ..... 269/41, 43, 45, 95, 228; 108/117
See application file for complete search history.

(56) References Cited

U.S. PATENT DOCUMENTS

| | | | | | |
|---|---|---|---|---|---|
| 4,143,602 | A * | 3/1979 | Brunn | 108/117 |
| 4,936,053 | A * | 6/1990 | Shanelec | 451/224 |
| 5,401,354 | A * | 3/1995 | Colucci | 156/580 |
| 5,494,553 | A * | 2/1996 | Colucci | 156/580 |
| 5,785,305 | A * | 7/1998 | Stalker | 269/37 |
| 5,992,836 | A * | 11/1999 | Howe | 269/41 |
| 6,003,851 | A * | 12/1999 | Araki et al. | 269/239 |
| 6,427,993 | B1 * | 8/2002 | Prochac | 269/37 |
| 7,168,693 | B1 * | 1/2007 | Sjuts et al. | 269/37 |
| 8,398,062 | B1 * | 3/2013 | Condit | 269/133 |
| 2008/0277852 | A1 * | 11/2008 | Kellerson | 269/60 |
| 2011/0068526 | A1 * | 3/2011 | Coffman | 269/41 |

* cited by examiner

*Primary Examiner* — Lee D Wilson
(74) *Attorney, Agent, or Firm* — Barnes & Thornburg LLP

(57) ABSTRACT

An adjustable clamp for maintaining two butting panels in an adjoining relationship. A clamping base is composed of a pair of base plates connected at each end with a scissor hinge allowing the plates to be secured at angles of from 0° to greater than 90° to one another. Clamp members are provided on each of the base plates for clamping panels in the desired butting relationship for gluing or otherwise joining the butting panels along their butting edges.

9 Claims, 10 Drawing Sheets

ADJUSTABLE ANGLE CLAMP

BACKGROUND OF THE INVENTION

This invention relates to clamping of two pieces or panels in an adjoining relationship, and more particularly to an adjustable clamp for maintaining a desired butting angular relationship between the two panels so that the panels can be glued or otherwise joined to one another.

When joining two flat panels, such as pieces of plastic or wood, to one another, it is necessary to maintain the panels in a butting relationship temporarily so that they can be glued or otherwise joined at their junction. In applicant's previous U.S. Pat. No. 6,318,712, disclosed is an angle gluing clamp for joining pieces at a fixed angle to one another, such as a 90° angle.

Various devices have been developed in the past for clamping two pieces or segments for joining them to one another, as explained in prior U.S. Pat. No. 6,318,712. However, except for the '712 patent, because of the construction of the devices, application of glue to join pieces to one another is difficult unless the glue is applied before the pieces are clamped and joined. Such is not an impediment in the '712 patent or the invention of the present application.

SUMMARY OF THE INVENTION

The invention provides an adjustable clamp for maintaining two butting segments or panels in an angular adjoining relation to one another. It includes a clamping base, which comprises a pair of elongated, parallel, base plates adjacent one another and a scissor hinge at each end of the base plates, with the scissor hinges connecting the base plates in a spaced relationship and variably hingedly securing the base plates at angles of from 0° to greater than 90° to one another. First and second clamp members are provided, each clamp member being adjustably secured to a respective one of the base plates. An operating element for each clamp member is provided for movably positioning each clamp member in relation to its respective base plate.

In accordance with the preferred form of the invention, each operating element comprises a pair of bolts extending from the base plate, with each bolt extending through an aperture in the clamp member, and including an adjustable fastener on each bolt proximate the clamp member. Preferably, the fastener comprises a nut, which is knurled.

The scissor hinge comprises a pair of slide plates, the slide plates being connected together at a pivot junction proximate to and spaced from a first end of each of the slide plates. The first ends are connected to a pivot point on one of the base plates, and each slide plate is slidably connected at a second end to a slide point on a second of the base plates. Preferably, each slide plate includes a longitudinal slot, with the slide point extending into the slot. A lock is provided for securing the base plates at a desired angle. To that end, each pivot point and each slide point includes a screw extending from the base plate, and the lock comprises an adjustable nut threaded on each of at least some of the screws, and preferably all of the screws.

BRIEF DESCRIPTION OF THE DRAWINGS

The invention is described in greater detail in the following description of examples embodying the best mode of the invention, taken in conjunction with the drawing figures, in which.

DESCRIPTION OF EXAMPLES EMBODYING THE BEST MODE OF THE INVENTION

Figure 1:
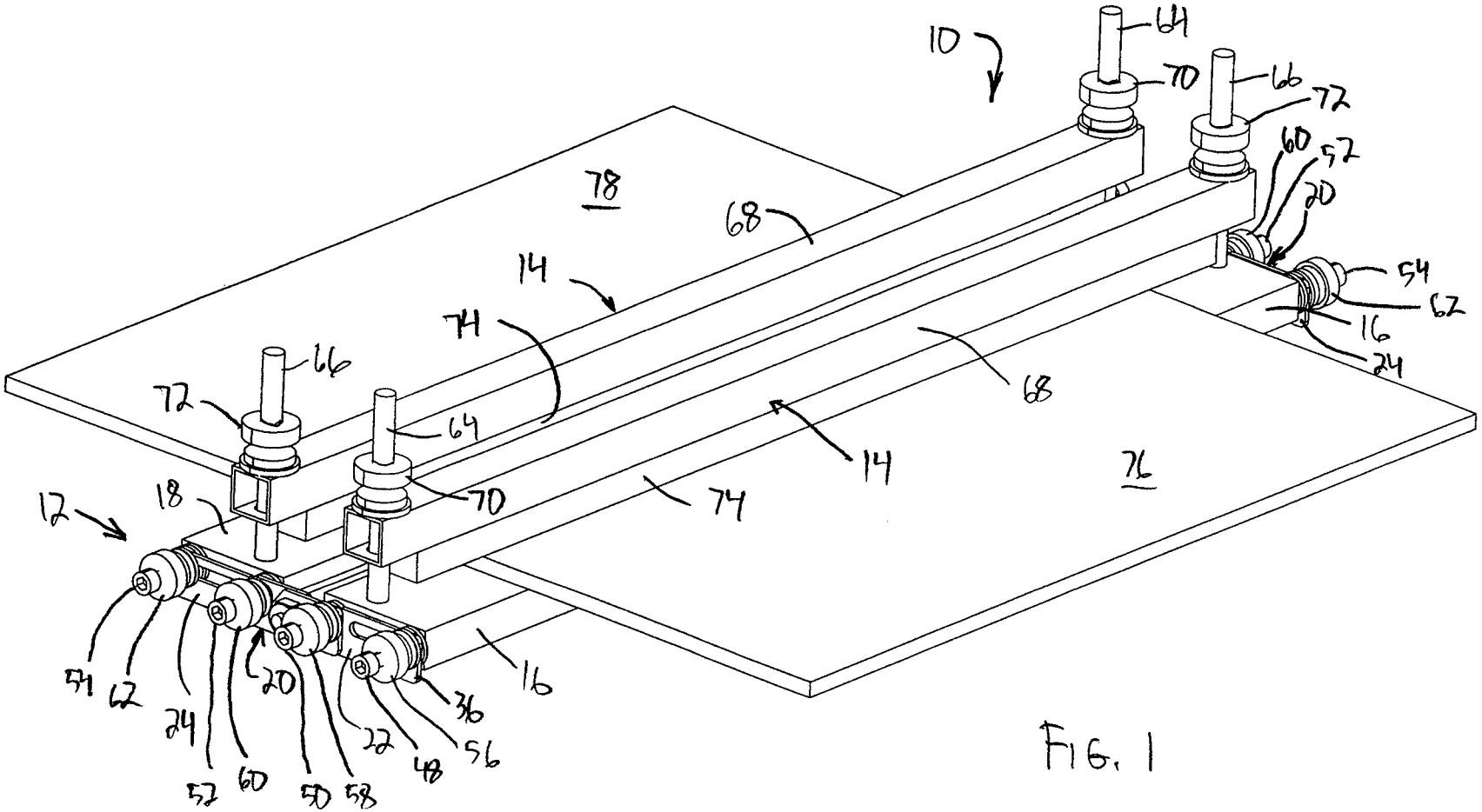
FIG. 1 is an isometric view of an adjustable clamp according to the invention, when oriented at 0° so that butting plates are joined at no included angle to one another.
Figure 2:
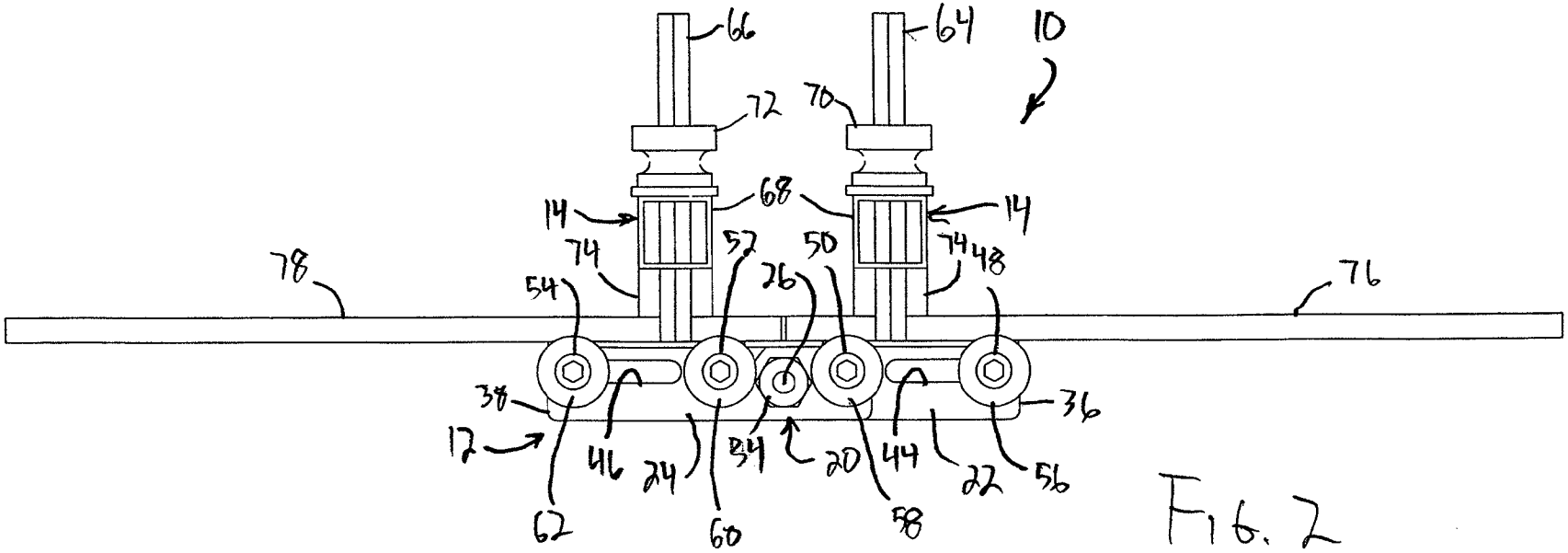
FIG. 2 is an enlarged, side elevational illustration of the apparatus shown in FIG. 1.
Figure 3:
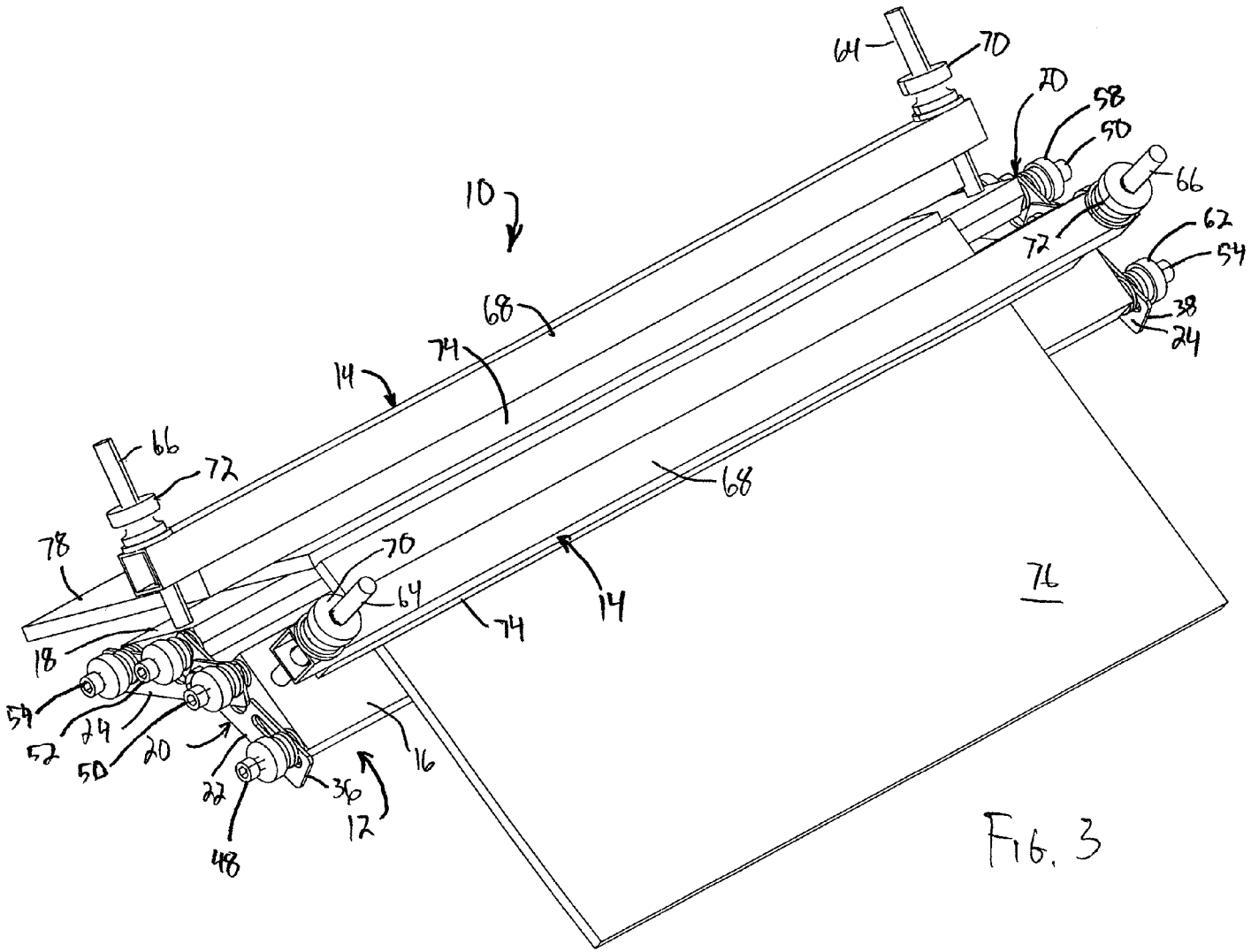
FIG. 3 is a view similar to FIG. 1, but with the adjustable clamp oriented with each of the base plates at an angle of about 35° to horizontal.
Figure 4:
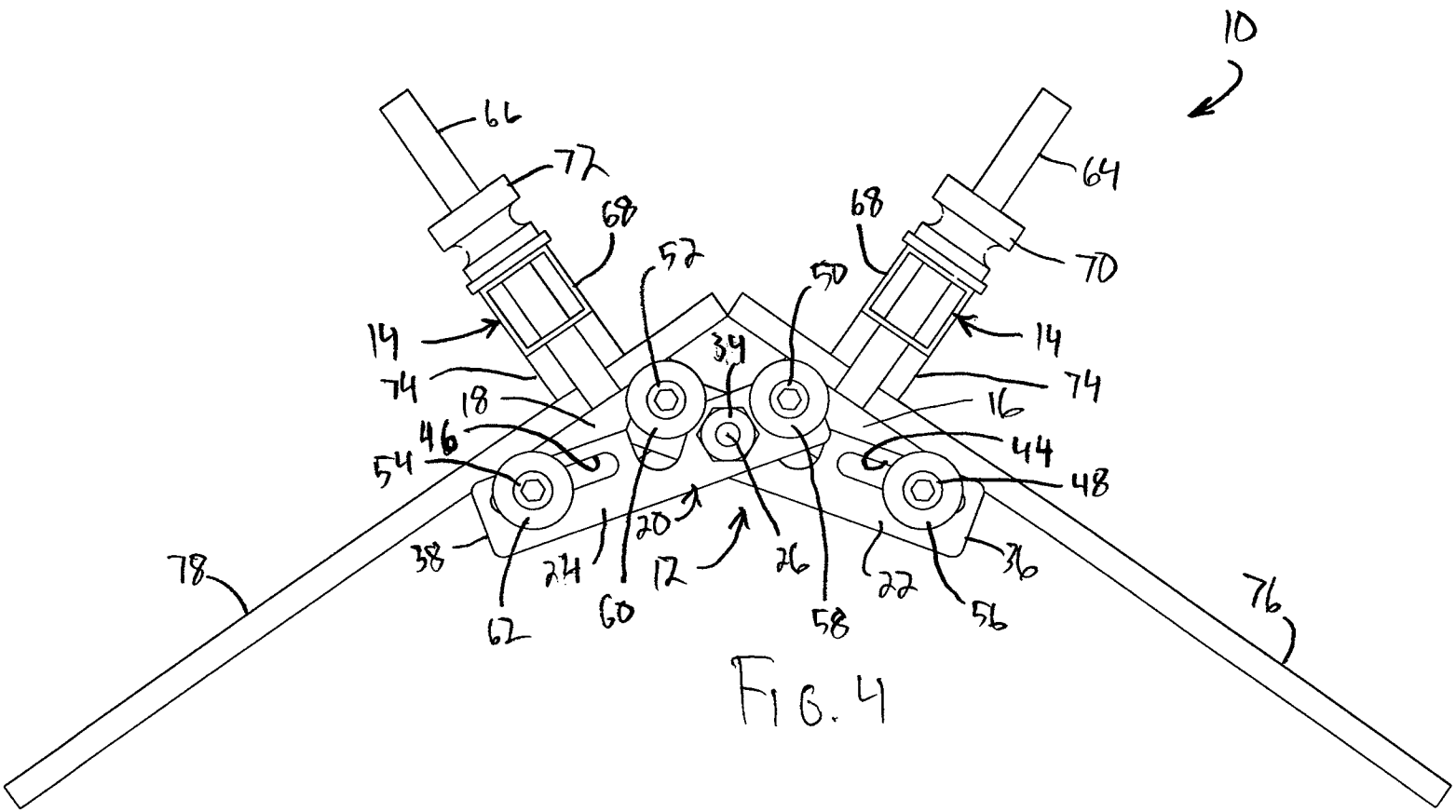
FIG. 4 is an enlarged side elevational illustration of the orientation shown in FIG. 3.
Figure 5:
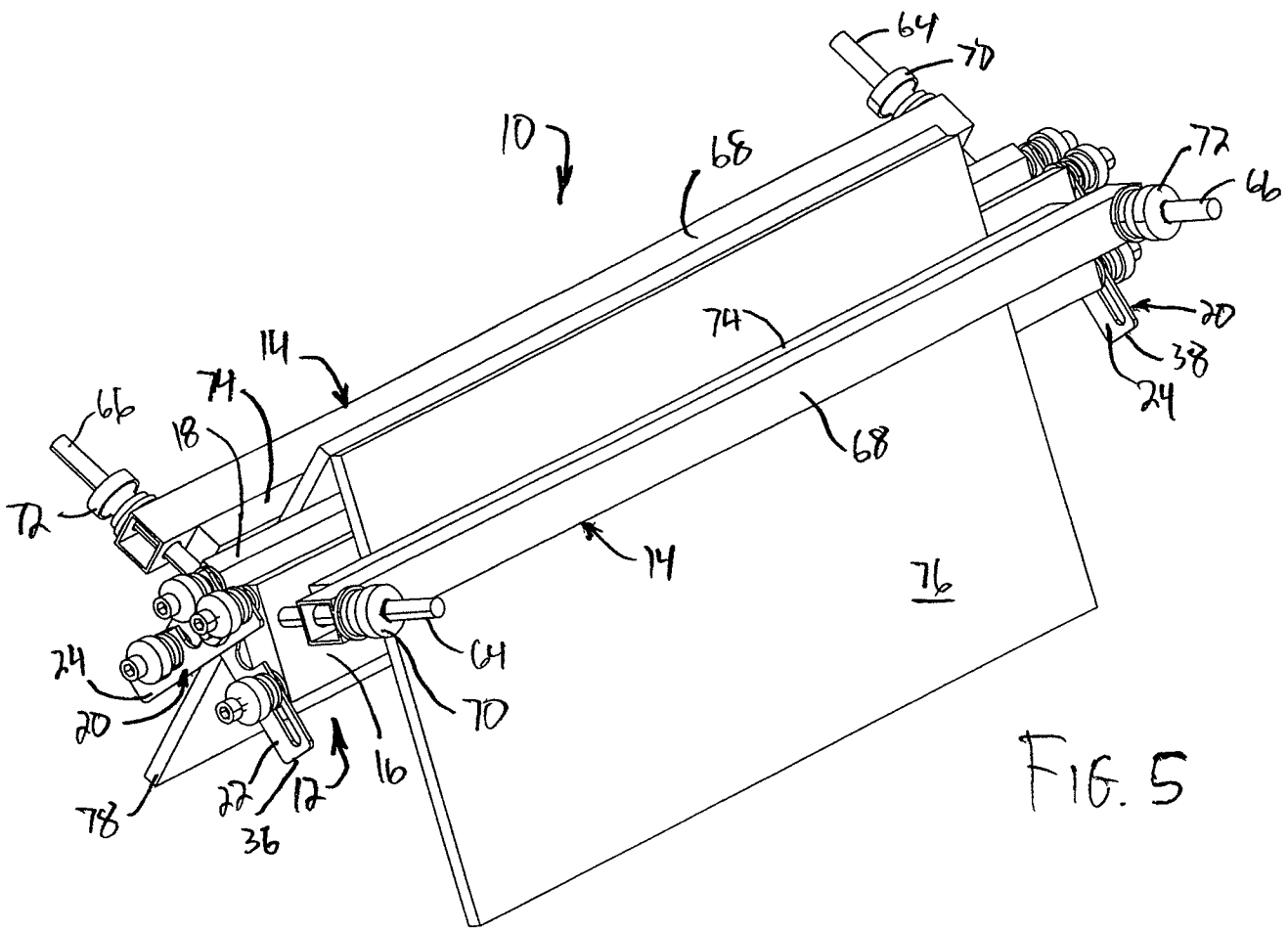
FIG. 5 is a view similar to FIG. 1, but with the base plates oriented at an angle of about 66° from horizontal.
Figure 6:
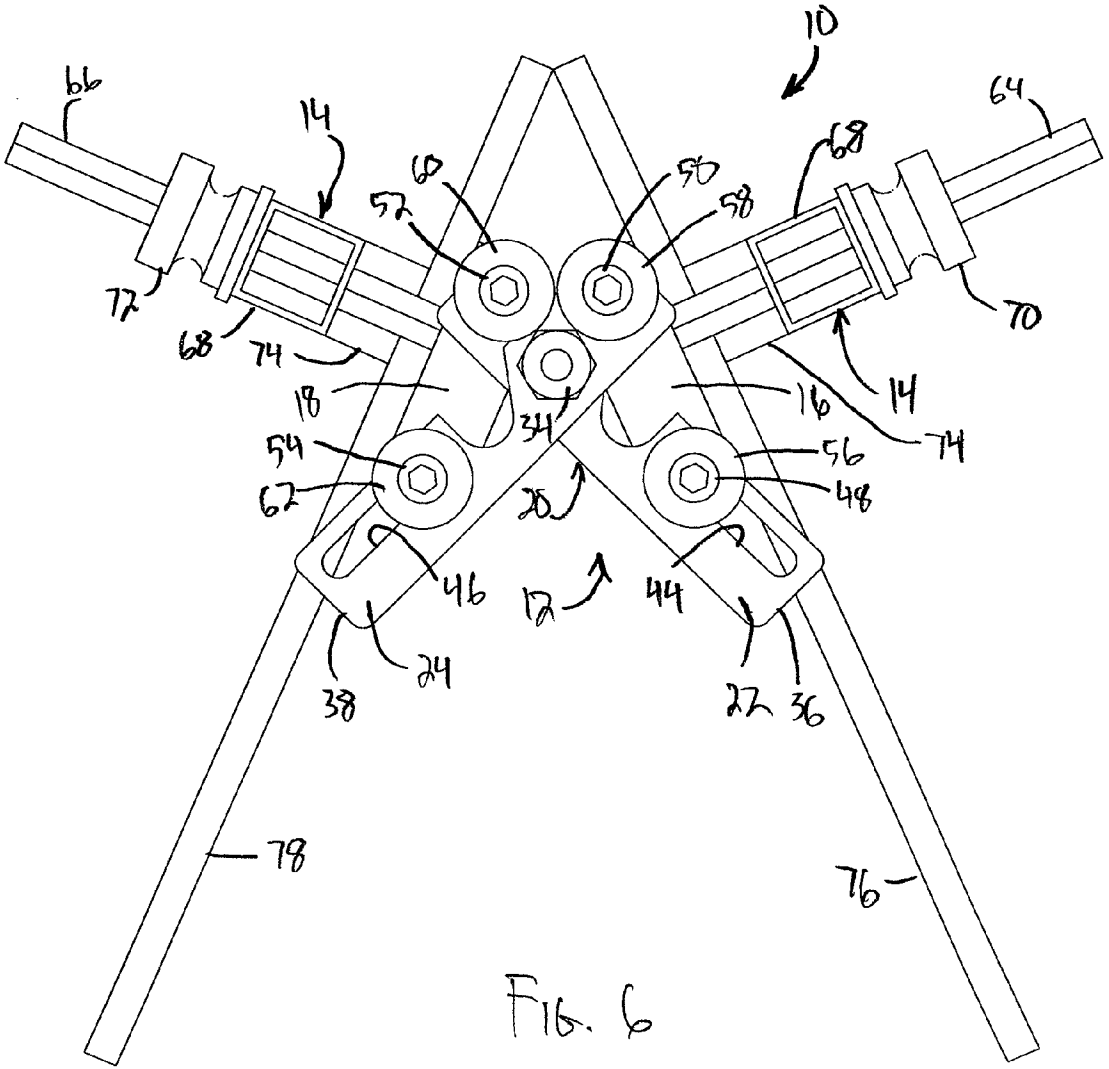
FIG. 6 is an enlarged, side elevational illustration of the orientation shown in FIG. 5.

An adjustable clamp according to the invention is shown generally at 10 in the drawing figures. The clamp 10 comprises two basic components, a clamping base 12 and clamp members 14 adjustably secured to the clamping base 12, as described in further detail below.

The clamp base 12 is composed of a pair of elongated, parallel, base plates 16 and 18 that are spaced and adjacent to one another. The base plates 16 and 18 preferably are metal or some other solid material that is not susceptible to bending or warping, and can carry the various other elements of the invention as described herein.

The base plates 16 and 18 are connected at each end by a scissor hinge 20. The scissor hinges 20 connect the base plates 16 and 18 in the spaced relationship shown in the drawing figures and allow variable hinging of the base plates at angles of from 0° to greater than 90° to one another.

Figure 7:
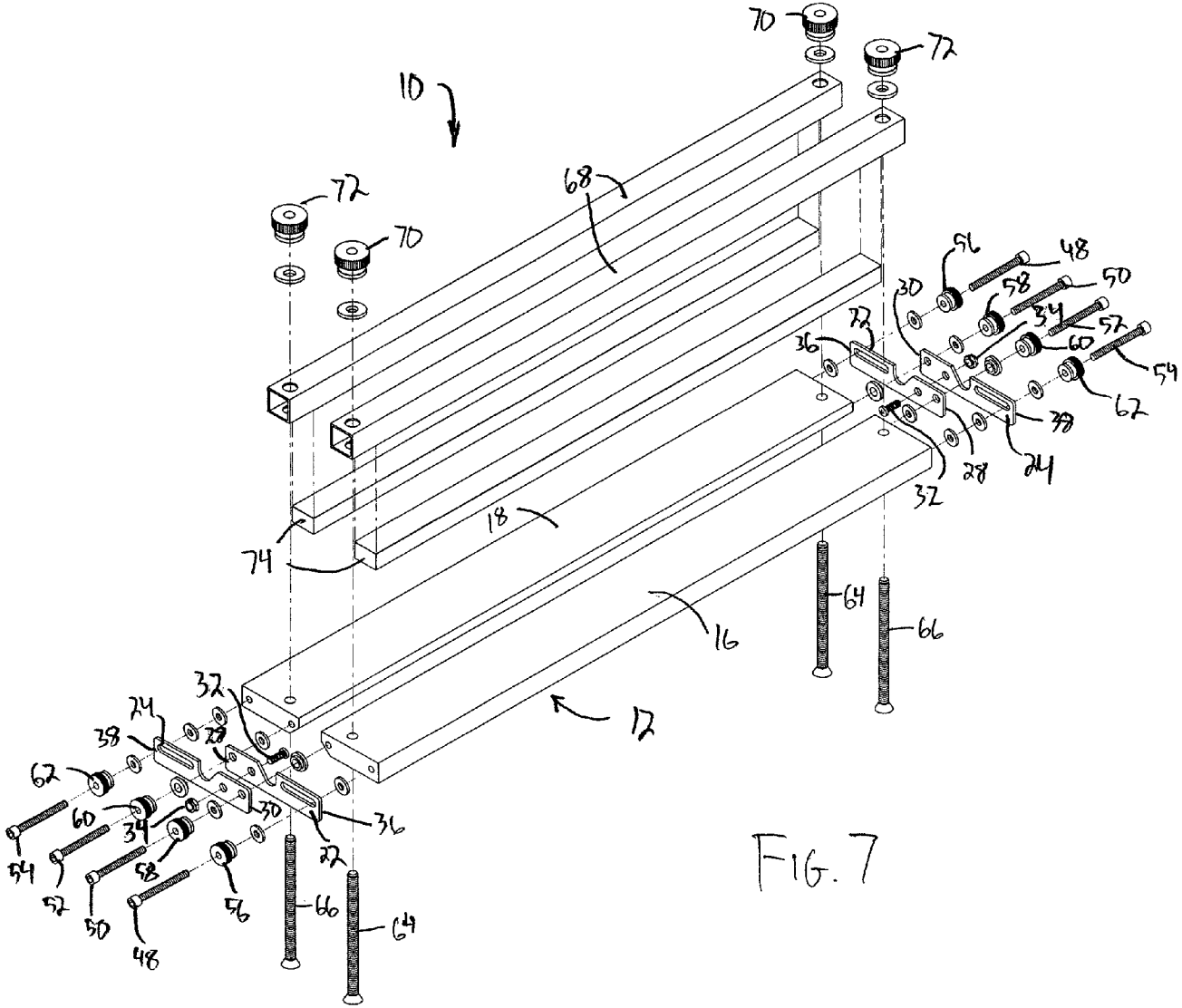
FIG. 7 is an exploded view of the assembly of the elements of the invention.

Each scissor hinge 20 comprises a pair of slide plates 22 and 24. The slide plates 22 and 24 are connected together at a pivot junction 26 which is proximate to and spaced from a first inner end 28 and 30 of the respective side plates 22 and 24, as best shown in FIGS. 7 through 10. Preferably, for connecting at the pivot junction 26, a screw 32 and nut 34 are used, passing through appropriate apertures in the respective slide plates 22 and 24, as best shown in FIG. 7.

Figure 8:
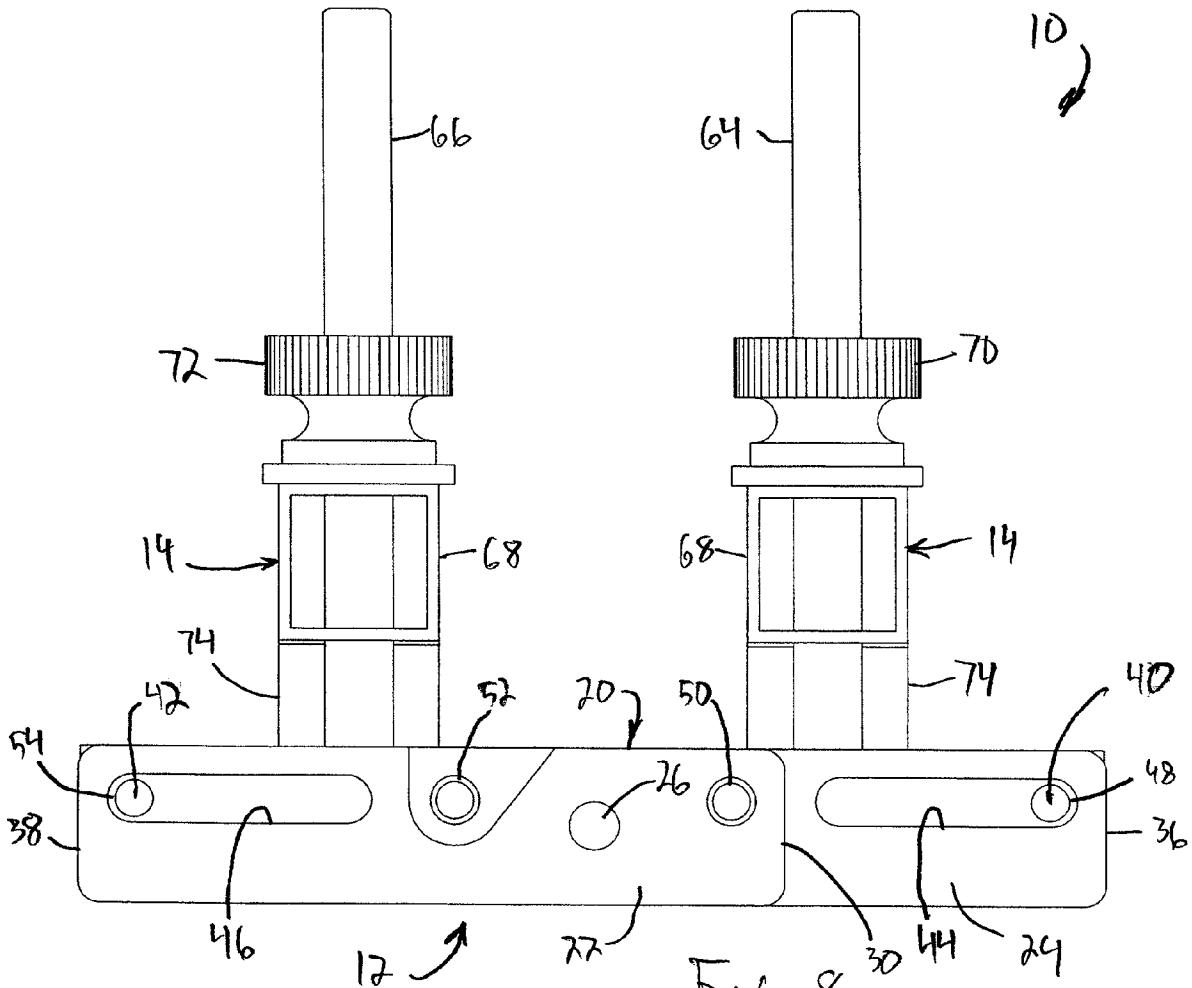
FIG. 8 is an enlarged end view, similar to FIG. 2, without the butting panels and with some elements eliminated to illustrate detail.
Figure 9:
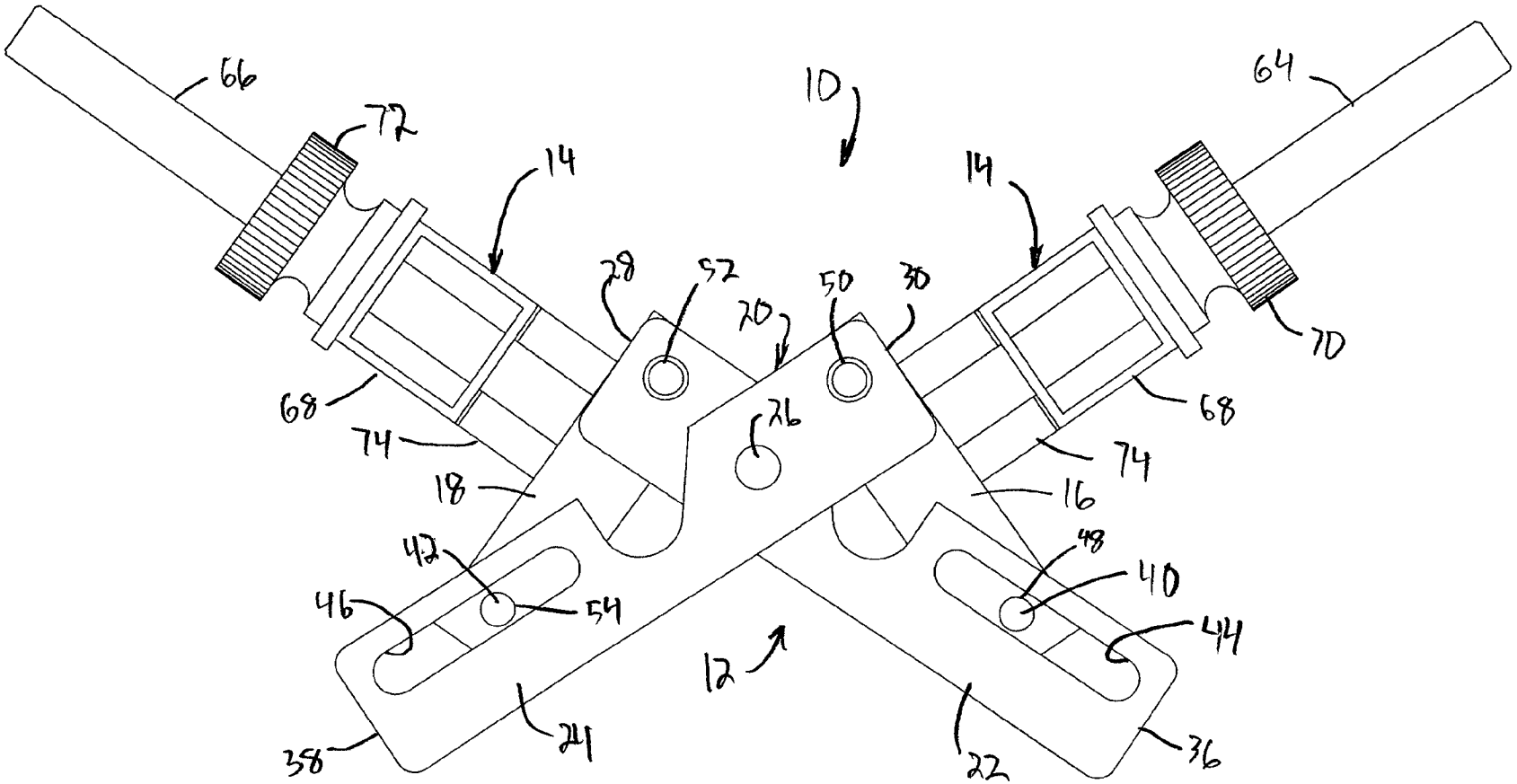
FIG. 9 is a view similar to FIG. 8, but with the base plates oriented at the angle shown in FIG. 4.
Figure 10:
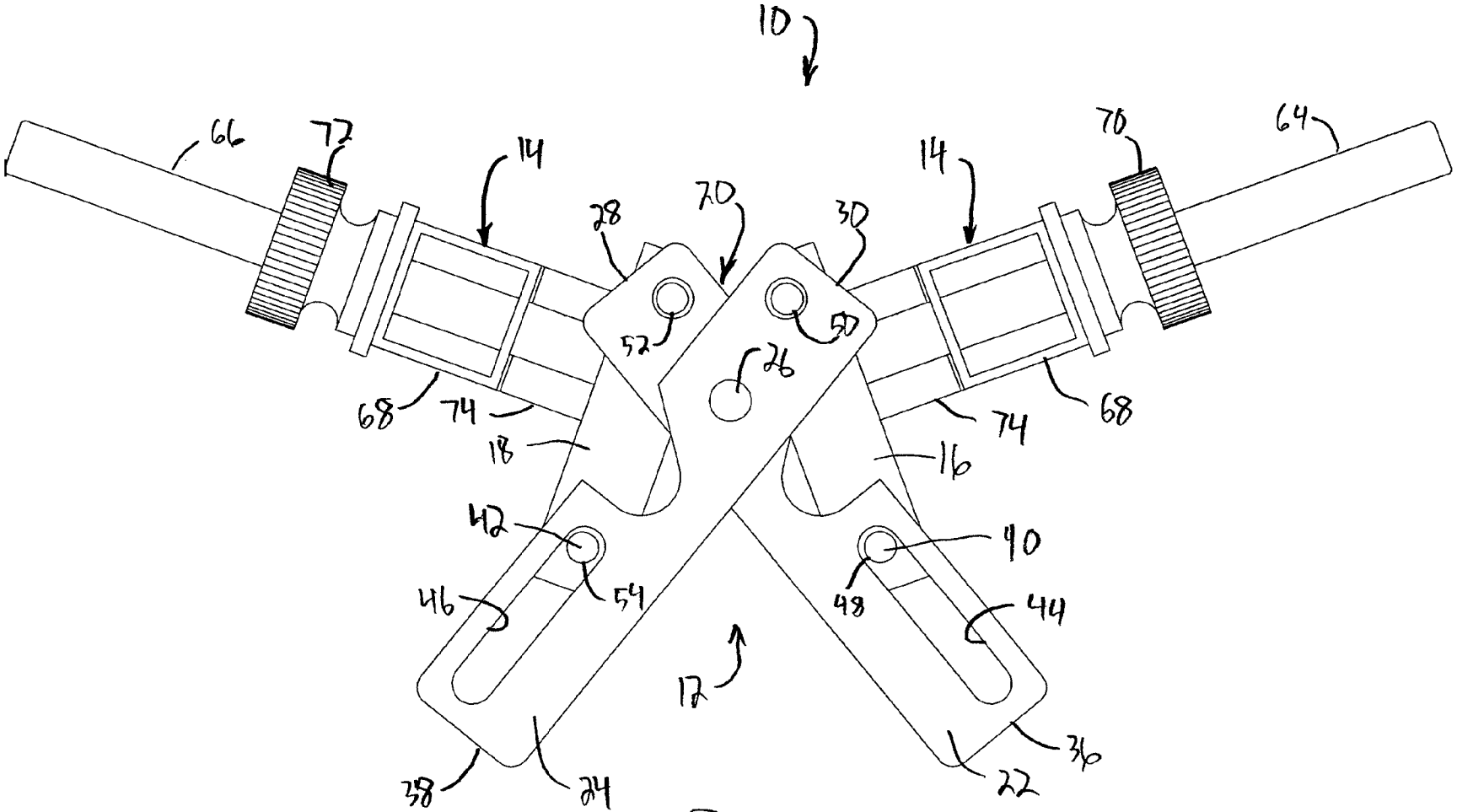
FIG. 10 is a view similar to FIG. 8, but with the base plates oriented at an angle similar to FIG. 6.

Each of the slide plates 22 and 24 is slidably connected at its respective second outer end 36 and 38 to a respective slide point 40 and 42, the slide point 40 being located on the base plate 16 and slide point 42 being located on the base plate 18, as illustrated in FIGS. 8 through 10.

For adjustment purposes, each of the slide plates 22 and 24 includes a respective longitudinal slot 44 and 46. As illustrated in FIGS. 8 through 10, the slide points 40 and 42 extend into their respective slots 44 and 46.

As shown in the drawing figures, each of the scissor hinges 20 is completed with four screws 48, 50, 52 and 54 extending longitudinally from the ends of the base plates 16 and 18. An adjustable nut 56, 58, 60 or 62 is mounted on a respective one of the screws 48 through 54, as illustrated. The screws 48 through 54, when installed, are fixed in place. The nuts 56 through 62, on the other hand, are threadedly adjustable on their respective screws 48 through 54 so as to provide a lock for securing the base plates 16 and 18 at a desired angle are shown in FIGS. 1 through 6. When the adjustable nuts 56 through 62 are tightened on their respective screws 48 through 54, the scissor hinges 20 are locked, and the base plates 16 and 18 are then maintained at whatever angle is desired.

The clamp members 14 are identical to one another. Each is composed of a pair of bolts 64 and 66 threaded into and rising from their respective base plates 16 and 18. The bolts 64 and 66 pass through appropriate apertures in a clamp member 68. A nut 70 and 72 is threaded onto its respective bolt 64 and 66 to engage the clamp member 68. For cushioning purposes, each of the clamp members 68 may also be underlain by a pad 74, such as a foam strip. Thus, anything clamped by the clamp member 68 will be appropriately cushioned.

In use, the adjustable clamp 10 is used to maintain two butting panels or segments 76 and 78 in a desired angular relationship with their abutting edges joining one another. Thus, as shown in FIGS. 1 through 6, the panels 76 and 78 are inserted in the clamp 10, and the clamp members 14 are then tightened to maintain the panels 76 and 78 in place by means of tightening the nuts 70 and 72 on their respective bolts 64 and 66. Thereafter, the butting edges of the panels 76 and 78 can be glued or otherwise joined to one another, and when the junction of the butting panels 74 and 76 is appropriately cured, the clamp members 14 can be released by either loosening, or entirely removing, the nuts 70 and 72 with the clamp members 68 then being removed. The joined panels 76 and 78 are then readily removed from the adjustable clamp 10.

As illustrated in the drawing figures, the geometry of the hinging of the elements of the invention keeps the joined panels 76 and 78 as close together as possible to their respective base plates 16 and 18 while still leaving room between the plates 16 and 18 to access the inside of the joint between the panels 76 and 78. For thin materials, this is particularly important. As the angle between the base plates 16 and 18 progresses from flat or 180 degrees in FIGS. 1 and 2 through increasingly tighter angles to those shown in FIGS. 5 and 6, the base plates 16 and 18 get drawn close together as the angle increases. The location of the pivot junction 26 controls this. Thus, moving the pivot junction 26 upwardly or downwardly (in relation to FIG. 2) can change how far the base plates 16 and 18 are spaced from one another as the angles between them change.

The clamp according to the invention provides a simple, yet highly effective device for clamping two pieces of material together, while affording full access to the junction of those pieces of material to allow joining at their butting edges.

Various changes can be made to the invention without departing from the spirit thereof or scope of the following claims.

What is claimed is:

1. An adjustable clamp for maintaining two butting segments in an angular adjoining relation to one another, comprising a. a clamping device base comprising, i. a pair of elongated, parallel, base plates adjacent one another, and ii. a scissor hinge at each of said base plates, said scissor hinges connecting said base plates in a spaced relationship and variably hingedly securing said base plates at angles of from 0° to greater than 90° to one another, each of said scissor hinges comprising a pair of slide plates, said slide plates being connected together at a pivot junction, b. first and second clamp members, each clamp member being adjustably secured to a respective one of said base plates, and c. an operating element for each clamp member for movably positioning each said clamp member in relation to its respective base plate.

2. The adjustable clamp according to claim 1, in which each said operating element comprises a pair of bolts extending from said base plate, each bolt extending through an aperture in said clamp member, and including an adjustable fastener on each bolt proximate said clamp member.

3. The adjustable clamp according to claim 2, in which said fastener comprises a nut.

4. The adjustable clamp according to claim 3, in which said nut is knurled.

5. The adjustable clamp according to claim 1, in which each pivot junction is proximate to and spaced from a first end, each first end being connected to a pivot point on one of said base plates, and each slide plate being slidably connected at a second end to a slide point on a second of said base plates.

6. The adjustable clamp according to claim 5, in which each slide plate includes a longitudinal slot, said slide point extending into said slot.

7. The adjustable clamp according to claim 6, including a lock for securing said base plates at a desired angle.

8. The adjustable clamp according to claim 7, in which each pivot point and each slide point includes a screw extending from said base plate, said lock comprising an adjustable nut threaded on each of at least some of screws.

9. The adjustable clamp according to claim 8, including an adjustable nut threaded on each of said screws.

* * * * *